US009894950B1

(12) United States Patent
Borslien

(10) Patent No.: US 9,894,950 B1
(45) Date of Patent: Feb. 20, 2018

(54) CACTUS HAVING INTEGRAL LIGHTS

(71) Applicant: Kevin Borslien, Greenwood, WI (US)

(72) Inventor: Kevin Borslien, Greenwood, WI (US)

( * ) Notice: Subject to any disclaimer, the term of this patent is extended or adjusted under 35 U.S.C. 154(b) by 0 days.

(21) Appl. No.: 15/225,957

(22) Filed: Aug. 2, 2016

(51) Int. Cl.

| | |
|---|---|
| ***F21L 4/02*** | (2006.01) |
| ***A41G 1/00*** | (2006.01) |
| ***F21S 9/03*** | (2006.01) |
| ***F21V 33/00*** | (2006.01) |
| *F21W 121/00* | (2006.01) |

(52) U.S. Cl.
CPC ..... *A41G 1/005* (2013.01); *F21S 9/037* (2013.01); *F21V 33/0028* (2013.01); *F21W 2121/00* (2013.01)

(58) Field of Classification Search
CPC ..... A41G 1/00; A41G 1/005; A41G 1/007; F21V 33/0028; F21S 9/02; F21S 9/037; F21W 2121/00
See application file for complete search history.

(56) References Cited

U.S. PATENT DOCUMENTS

| | | | | |
|---|---|---|---|---|
| 4,910,647 | A | 3/1990 | Gong | |
| 5,213,855 | A | 5/1993 | Buxton | |
| D413,001 | S | 8/1999 | Nowosielski | |
| 6,030,670 | A * | 2/2000 | Chang | A41G 1/005 362/123 |
| 6,318,876 | B1 | 11/2001 | Sigro | |
| 7,097,889 | B1 | 8/2006 | Carroll | |
| 7,108,391 | B2 | 9/2006 | Chuang | |
| 7,118,788 | B1 * | 10/2006 | Turner | A41G 1/00 428/17 |
| 7,249,863 | B2 * | 7/2007 | Ballarini | A45B 3/04 362/121 |
| D562,725 | S * | 2/2008 | Keller | D11/117 |
| 7,888,584 | B2 * | 2/2011 | Lyden | H02J 7/355 136/244 |
| D733,954 | S | 7/2015 | Hawthorne | |
| 2005/0168973 | A1 * | 8/2005 | Chuang | A41G 1/005 362/122 |

FOREIGN PATENT DOCUMENTS

| | | | | |
|---|---|---|---|---|
| CN | 204340528 | * | 5/2015 | F21V 21/14 |
| WO | 2008039976 | A1 | 4/2008 | |

OTHER PUBLICATIONS

CN 204340528 (May 20, 2015) Li, English Translation.*

* cited by examiner

*Primary Examiner* — Peggy Neils

(57) ABSTRACT

The ornamental cactus having integral lights is a purely decorative cactus that includes a plurality of lights integrated into the construction of the decorative cactus. The plurality of lights is wired to a powering member. At least one solar cell is wired to the powering member in order to recharge the powering member. Ornamental flowers and insects may optionally adorn the decorative cactus. Lights may be wired into the ornamental flowers and insects to provide an enhanced appearance. In use, the lights illuminate the flower, insects, and decorative cactus.

5 Claims, 3 Drawing Sheets

CACTUS HAVING INTEGRAL LIGHTS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of ornamental items, more specifically, an ornamental cactus with lights that illuminate the ornamental cactus.

SUMMARY OF INVENTION

The ornamental cactus having integral lights is a purely decorative cactus that includes a plurality of lights integrated into the construction of the decorative cactus. The plurality of lights is wired to a powering member. At least one solar cell is wired to the powering member in order to recharge the powering member. Ornamental flowers and insects may optionally adorn the decorative cactus. Lights may be wired into the ornamental flowers and insects to provide an enhanced appearance. In use, the lights illuminate the flower, insects, and decorative cactus.

These together with additional objects, features and advantages of the ornamental cactus having integral lights will be readily apparent to those of ordinary skill in the art upon reading the following detailed description of the presently preferred, but nonetheless illustrative, embodiments when taken in conjunction with the accompanying drawings.

In this respect, before explaining the current embodiments of the ornamental cactus having integral lights in detail, it is to be understood that the ornamental cactus having integral lights is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ornamental cactus having integral lights.

It is therefore important that the claims be regarded as including such equivalent construction insofar as they do not depart from the spirit and scope of the ornamental cactus having integral lights. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
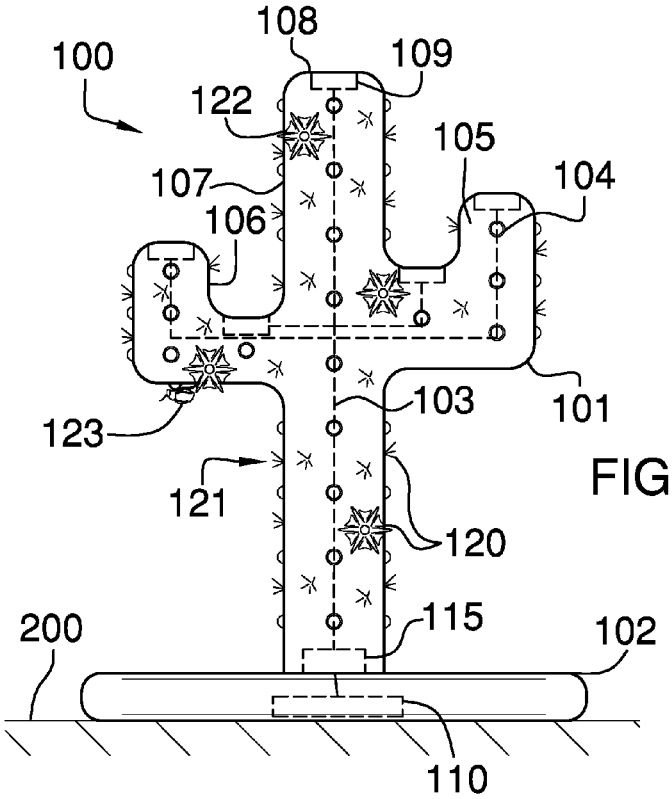
FIG. 1 is a front view of an embodiment of the disclosure.
Figure 2:
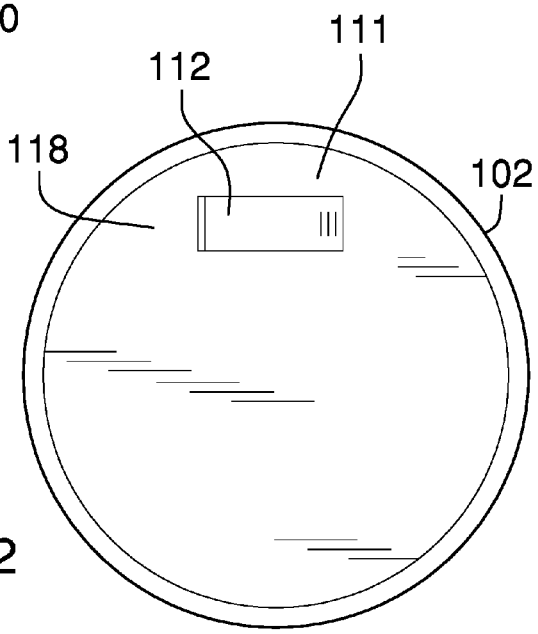
FIG. 2 is a bottom view of an embodiment of the disclosure.
Figure 3:
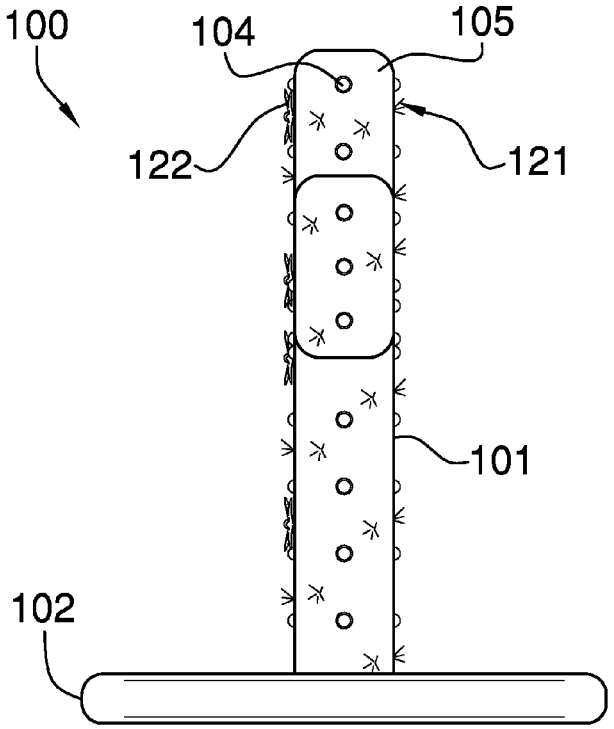
FIG. 3 is a side view of an embodiment of the disclosure.
Figure 4:
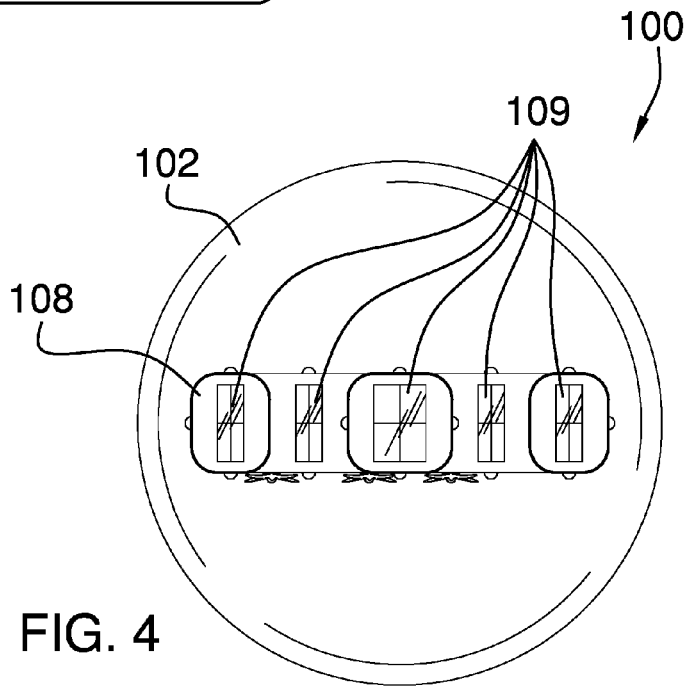
FIG. 4 is a top view of an embodiment of the disclosure.
Figure 5:
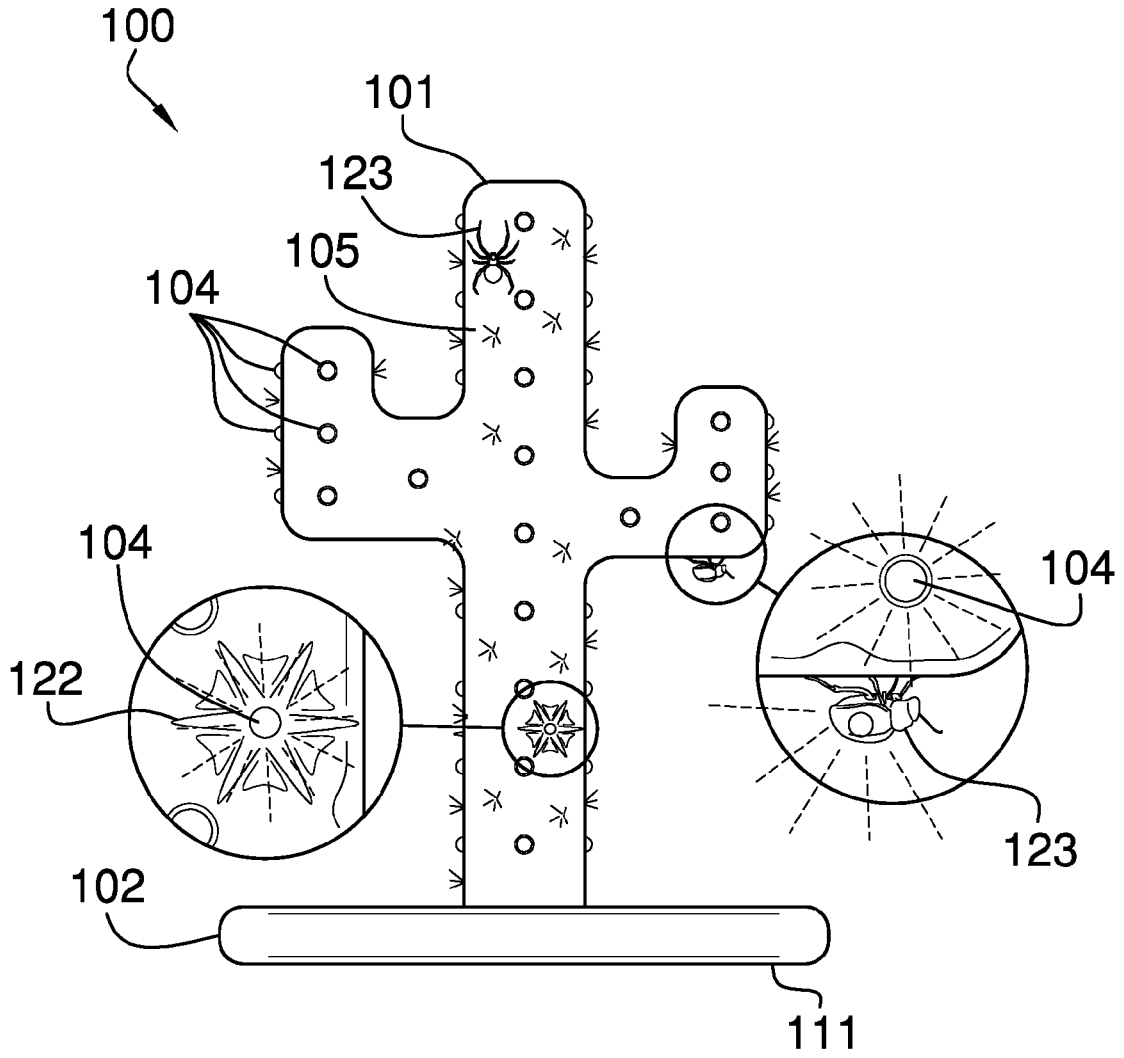
FIG. 5 is a rear view of an embodiment of the disclosure.

Detailed reference will now be made to a first potential embodiment of the disclosure, which is illustrated in FIGS. 1 through 5.

The ornamental cactus having integral lights 100 (hereinafter invention) comprises a decorative cactus 101 that is mounted atop of a base 102. The base 102 is adapted to rest on a surface 200. The decorative cactus 101 is of hollowed construction, and enables at least one wire 103 to traverse amongst a plurality of light members 104. The plurality of light members 104 is ideally light emitting diodes that are individually mounted into an outer surface 105 of the decorative cactus 101. The plurality of light members 104 is located at different locale across the entire outer surface 105 of the decorative cactus 101.

The decorative cactus 101 includes at least one armature 106 that extends outwardly from a central cactus member 107. The at least one armature 106 and the central cactus member 107 are both defined with a top, outer surface 108. Located on the top, outer surface 108 is at least one solar cell 109. The at least one solar cell 109 is wired via the at least one wire 103 to a powering member 110. The powering member 110 is ideally located in the base 102. The powering member 110 is ideally at least one battery that is rechargeable. The powering member 110 provides electricity used to power the plurality of light members 104.

The base 102 may be further defined with a bottom base surface 111 that interfaces with the ground surface 200. The bottom base surface 111 includes a battery compartment cover 112 that when removed provides access to a battery compartment 113. The battery compartment 113 houses the powering member 110 therein. The powering member 110 may be wired to a charge regulator 115 that interfaces between the at least one solar cell 109 and the powering member 110.

The outer surface 105 of the decorative cactus 101 is adorned with decorative elements 120. The decorative elements 120 may include spines 121, flowers 122, and/or insects 123. The spines 121 are relatively small, and are provided across the entire outer surface 105 of the decorative cactus 101. The decorative elements 120 are made of a material comprising a plastic, rubber, wood, metal, etc. The flowers 122 and the insects 123 may have one of the plurality of light members 104.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An ornamental cactus comprising:

a decorative cactus having a plurality of light members integrated thereon so as to illuminate said decorative cactus;

wherein the decorative cactus is mounted atop of a base;

wherein the base is adapted to rest on a surface;

wherein the decorative cactus is of hollowed construction, and enables at least one wire to traverse amongst the plurality of light members;

wherein the plurality of light members are individually mounted into an outer surface of the decorative cactus;

wherein the plurality of light members is located at different locale across the entire outer surface of the decorative cactus;

wherein the decorative cactus includes at least one armature that extends outwardly from a central cactus member;

wherein the at least one armature and the central cactus member are both defined with a top, outer surface;

wherein located on the top, outer surface is at least one solar cell;

wherein the at least one solar cell is wired via the at least one wire to a powering member;

wherein the at least one solar cell generates electricity in order to recharge the powering member;

wherein the powering member is located in the base;

wherein the powering member is further defined as at least one battery that is rechargeable;

wherein the powering member provides electricity used to power the plurality of light members;

wherein the base is further defined with a bottom base surface that is adapted to interface with the ground surface;

wherein the bottom base surface includes a battery compartment cover that when removed provides access to a battery compartment;

wherein the battery compartment houses the powering member therein;

wherein the powering member is wired to a charge regulator that interfaces between the at least one solar cell and the powering member.

2. The ornamental cactus according to claim 1 wherein the outer surface of the decorative cactus is adorned with decorative elements.

3. The ornamental cactus according to claim 2 wherein the decorative elements is further defined as spines, flowers, and/or insects.

4. The ornamental cactus according to claim 3 wherein the spines are provided across the entire outer surface of the decorative cactus and resemble actual cactus spines.

5. The ornamental cactus according to claim 3 wherein the flowers and the insects each have one of the plurality of light members integrated therein.

* * * * *